US009728896B2

(12) United States Patent
Papurcu et al.

(10) Patent No.: US 9,728,896 B2
(45) Date of Patent: Aug. 8, 2017

(54) LEVER-TYPE ELECTRICAL CONNECTOR WITH CONNECTOR POSITIONING ASSURANCE MEMBER

(71) Applicant: Delphi Technologies, Inc., Troy, MI (US)

(72) Inventors: Necdet Papurcu, Datteln (DE); Klaus Storandt, Witten (DE); Andreas Weidemeyer, Neukirchen (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 14/852,719

(22) Filed: Sep. 14, 2015

(65) Prior Publication Data

US 2016/0099520 A1 Apr. 7, 2016

(30) Foreign Application Priority Data

Oct. 7, 2014 (EP) ..... 14187988

(51) Int. Cl.
*H01R 13/62* (2006.01)
*H01R 13/641* (2006.01)
*H01R 13/629* (2006.01)

(52) U.S. Cl.
CPC ..... *H01R 13/641* (2013.01); *H01R 13/62955* (2013.01)

(58) Field of Classification Search
CPC ..... H01R 13/641; H01R 13/62955
USPC ..... 439/157, 372, 752
See application file for complete search history.

(56) References Cited

U.S. PATENT DOCUMENTS 6,558,176 B1 * 5/2003 Martin ..... H01R 13/62944 439/157
7,137,844 B2 * 11/2006 Flowers ..... H01R 13/5812 439/372
7,384,285 B2 * 6/2008 Patterson ..... H01R 13/62955 439/157
7,481,661 B2 * 1/2009 Takahashi ..... H01R 13/62955 439/157
7,931,483 B2 * 4/2011 Komiyama ..... H01R 13/62977 439/157
8,221,142 B2 * 7/2012 Sakamaki ..... H01R 13/62955 439/157

(Continued)

*Primary Examiner* — Abdullah Riyami
*Assistant Examiner* — Nelson R Burgos-Guntin
(74) *Attorney, Agent, or Firm* — Robert J. Myers

(57) ABSTRACT

An electrical connector comprising a cover, a mating assist lever pivotally mounted to the cover and configured to pivot between an open position and a closed position, and a connector positioning assurance (CPA) member slideably mounted to the cover and configured to slide between an inoperative position and a locked position. The CPA member comprises a flexible locking arm that is bendable between a bent position and a rest position. The flexible locking arm comprises a blocking ramp that cooperates with a blocking shoulder on the cover to generate a first threshold force resisting the CPA member from sliding from the inoperative position to the locked position and a locking ramp that cooperates with the locking shoulder on the mate assist lever to bend the flexible locking arm from the rest position to the bent position to prevent the blocking ramp and the blocking shoulder from cooperating.

14 Claims, 9 Drawing Sheets

(56) References Cited

U.S. PATENT DOCUMENTS 8,235,742 B2 * 8/2012 Komiyama ..... H01R 13/62911 439/157
8,662,906 B2 * 3/2014 Schmitt ..... H01R 13/6273 439/157
8,684,756 B2 * 4/2014 Kobayashi ..... H01R 13/6295 439/157
8,882,521 B2 * 11/2014 Conway ..... H01R 13/5213 439/157
8,900,003 B2 * 12/2014 Aoki ..... H01R 13/629 439/372
9,379,486 B2 * 6/2016 Rodriguez ..... H01R 13/62922
9,407,038 B2 * 8/2016 Jozwiak ..... H01R 13/62961
2003/0199184 A1 * 10/2003 Martin ..... H01R 13/62944 439/157
2004/0192090 A1 * 9/2004 Flowers ..... H01R 13/5812 439/157
2005/0026484 A1 * 2/2005 Demuth ..... H01R 13/6295 439/157
2006/0040533 A1 * 2/2006 Koshy ..... H01R 13/533 439/157
2006/0089031 A1 4/2006 Flowers et al.
2006/0205254 A1 9/2006 Foltz et al.
2006/0211286 A1 * 9/2006 Shuey ..... H01R 13/641 439/157
2007/0197071 A1 * 8/2007 Patterson ..... H01R 13/62955 439/157
2007/0197081 A1 * 8/2007 Patterson ..... H01R 13/62955 439/372
2010/0099288 A1 * 4/2010 Hong ..... H01R 9/0518 439/274
2011/0021047 A1 * 1/2011 Komiyama ..... H01R 13/62977 439/157
2011/0034049 A1 * 2/2011 Shishikura ..... H01R 13/62944 439/157
2011/0312198 A1 * 12/2011 Komiyama ..... H01R 13/62977 439/157
2012/0028486 A1 * 2/2012 Suemitsu ..... H01R 13/56 439/157
2012/0034812 A1 * 2/2012 Tanaka ..... H01R 13/62938 439/372
2013/0052857 A1 * 2/2013 Sakaguchi ..... H01R 13/72 439/372
2013/0280935 A1 * 10/2013 Shishikura ..... H01R 13/62977 439/157
2014/0113480 A1 * 4/2014 Aoki ..... H01R 13/62933 439/372
2015/0295352 A1 * 10/2015 Kim ..... H01R 13/62938 439/157

* cited by examiner

LEVER-TYPE ELECTRICAL CONNECTOR WITH CONNECTOR POSITIONING ASSURANCE MEMBER

CROSS-REFERENCE TO RELATED APPLICATION

This application claims the benefit under 35 U.S.C. §119 (a) of Patent Application No. 14187988.2 filed in the European Patent Office (EPO) on Oct. 7, 2014, the entire disclosure of which is hereby incorporated by reference.

TECHNICAL FIELD OF THE INVENTION

The present invention relates generally to lever-type electrical connectors and, in particularly, to a lever-type electrical connector having a connector position assurance (CPA) member slideably mounted directly to the lever of the connector.

BACKGROUND OF THE INVENTION

Electrical connectors of the lever-type are known and traditionally comprise a housing, a mate assist lever and a connector positioning assurance (CPA) member.

The mate assist lever is pivotally mounted to the housing. By actuating, i.e. rotating, the mate assist lever from an open to a closed position the connection between the electrical connector and a complementary mating connector is assisted. Typically, the electrical connector and the complementary mating connector operate through some form of cam groove/cam follower arrangement for drawing the complementary mating connector into mating condition with the electrical connector in response to rotation of the mate assist lever.

Also known is to use a CPA member that is slideably arranged on the housing for locking the mate assist lever in the closed position to the housing.

The above type of electrical connectors is delivered to the user in an inoperative condition. The mate assist lever is in the open position and the CPA member is in the inoperative position.

The complementary mating connector is brought in a pre-mate condition with respect to the electrical connector and subsequently the mate assist lever is actuated to the closed position such that it draws the complementary mating connector into mating condition with the electrical connector.

Subsequently the CPA member is actuated from the inoperative position to a locked position for locking the mate assist lever to the housing.

A drawback of this electrical connector is that when the electrical connector is in the inoperative condition, the CPA member may accidently slide into the locked position. This is undesirable, as the CPA member may now block the mate assist lever to be actuated from the open position to the closed position.

A further drawback is that when the mate assist lever is in the closed position, a locking force needed to slide the CPA member from the inoperative position to the locked position is equal to an unlock force needed to slide the CPA member from the locked position to the inoperative position. A user wants to lock the CPA member easily when the mate assist lever is in the correct closed position. However, the CPA member should not be easily unlocked when it's in the correct locked position.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with an embodiment of the invention, an electrical connector is mateable with a complementary mating connector. The electrical connector comprises a cover, a mating assist lever and a connector positioning assurance (CPA) member. The cover comprises a blocking shoulder. Preferably, the cover is part of a housing. The cover preferably is a wire cover and suitable for receiving wires internally and covering them. The mating assist lever is pivotally mounted to the cover for being pivotable between an open position and a closed position. By actuating the mating assist lever from the open position to the closed position, the complementary mating connector is drawn to the electrical connector into mating condition by means of a cam groove/cam follower arrangement. The mating assist lever comprises a locking shoulder.

The connector positioning assurance (CPA) member is slideably mounted to the cover for being slideable between an inoperative position and a locked position. The CPA member comprises a flexible locking arm being bendable between a bent position and a rest position. The flexible locking arm comprises a blocking ramp for cooperating with the blocking shoulder.

When the mating assist lever is in the open position and the CPA member is moved from the inoperative position to the locked position, the flexible locking arm is in the rest position and the blocking ramp and the blocking shoulder cooperate so as to generate a first threshold force. The first threshold force resists the CPA member from sliding from the inoperative position to the locked position.

The CPA member comprises further a locking ramp for cooperating with the locking shoulder. When the mating assist lever is in the closed position and the CPA member is moved from the inoperative position to the locked position, the locking ramp and locking shoulder cooperate so as to bend the flexible locking arm from the rest position to the bent position such that it prevents the blocking ramp and the blocking shoulder to cooperate.

Due to the flexible locking arm with the blocking ramp and the locking ramp different actuating forces are required for moving the CPA member from the inoperative position to the lock position and vice versa, depending on the positions of the CPA member and/or the mate assist lever. This provides a solution to the different actuating force requirements for sliding the CPA member for different positions of the mate assist lever and the CPA member itself.

The invention relates further to a connector assembly comprising an electrical connector according to the invention and/or an intermediate housing and/or a movable connection part and/or the complementary mating connector.

In an embodiment of the electrical connector according to the invention the bending of the flexible locking arm from the rest position to the bend position requires overcoming a second threshold force. The second threshold force is lower than the first threshold force. This has as advantage that it may allow for a low actuation force of the CPA member when the mate assist lever is in a correct position, i.e. the locked position. At the same time a higher actuation force is required to actuate the CPA member when the mate assist lever is in an incorrect position, i.e. the open position.

In an embodiment of the electrical connector according to the invention the mating assist lever comprises a lever pocket. The locking shoulder is arranged in an interior of the lever pocket. The interior of the lever pocket is arranged to receive the locking ramp. This has as advantage that it allows a relief or relaxation of the flexible locking arms as the lever pocket provides the interior for receiving the flexible locking arms in the rest position. The locking arms are relaxed and/or non-bended when received in the lever pocket and may allow for a longer life time of the electrical connector.

In an embodiment of the electrical connector according to the invention the electrical connector is arranged such that when the mating assist lever is in the closed position and the CPA member is in the locked position the flexible locking arm is in the rest position. This has as advantage that it allows a relief or relaxation of the flexible locking arms as the lever pocket provides the interior for receiving the flexible locking arms in the rest position. The locking arms are relaxed and/or non-bended when received in the lever pocket and may allow for a longer life time of the electrical connector.

In an embodiment of the electrical connector according to the invention the electrical connector is arranged such that when the mating assist lever is in the closed position and the CPA member is moved from the locked position to the inoperative position, the locking ramp and the locking shoulder cooperate such as to bend the flexible locking arm from the rest position to the bend position. This has as advantage that it allows for a safety mechanism against accidently unlocking the mate assist lever when it is locked to the cover by the CPA member.

In an embodiment of the electrical connector according to the invention the locking ramp is arranged on a distal end of the flexible locking arm. The blocking ramp is arranged between the locking ramp and a proximal end of the flexible locking arm.

In an embodiment of the electrical connector according to the invention sliding the CPA member from the inoperative position to the locked position defines a slide direction. The flexible locking arm is arranged with a longitudinal axis parallel with the slide direction.

In an embodiment of the electrical connector according to the invention a rotating axis of the mating assist lever is perpendicular to the slide direction.

In an embodiment of the electrical connector according to the invention a mating axis between the electrical connector and the complementary electrical connector lies in a same imaginary plane with the slide direction. The mating axis and the slide direction are arranged with an angle of less than 90 degrees between them, preferably less than 80 degrees and more preferably less than 60 degrees.

In an embodiment of the electrical connector according to the invention the flexible locking arm comprises a first and a second locking ramp extending sideways in opposite directions from a longitudinal axis of the flexible locking arm. The mate assist lever comprises a first and a second locking shoulder that respectively cooperate with the first and second locking ramps.

In an embodiment of the electrical connector according to the invention the flexible locking arm comprises a first and a second blocking ramp extending sideways in opposite directions from a longitudinal axis of the flexible locking arm. The cover comprises a first and a second blocking shoulder that respectively cooperate with the first and second blocking ramps.

In an embodiment of the electrical connector according to the invention the CPA member comprises a CPA pocket and an auxiliary shoulder. The cover comprises a flexible lance arranged with an auxiliary ramp. The auxiliary shoulder is arranged in an interior of the CPA pocket. The interior of the CPA pocket is arranged to receive the auxiliary ramp.

In an embodiment of the electrical connector according to the invention the electrical connector is arranged such that when the mating assist lever is in the open position and the CPA member is moved from the inoperative position to the locked position, the flexible lance is in a rest position. In this rest position the auxiliary ramp and the auxiliary shoulder cooperate so as to resist against the CPA member from sliding from the inoperative position to the locked position by bending the flexible lance from the rest position to a bended position.

In an embodiment of the electrical connector according to the invention the electrical connector is arranged such that when the mating assist lever is in the closed position and the CPA member is moved from the locked position to the inoperative position, the auxiliary ramp and the auxiliary shoulder cooperate such as to bend the flexible lance from the rest position to the bend position so as to provide a resistance.

In an embodiment of the electrical connector according to the invention the bending of the flexible lance from the rest position to the bend position requires overcoming a third threshold force. The third threshold force is smaller than the first threshold force.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

The present invention provides a solution or at least an alternative to above drawbacks. In particular, it provides a solution or at least an alternative to the problem of having different actuating force requirements for sliding the CPA member for different positions of the mate assist lever and the CPA member itself.

Figure 1:
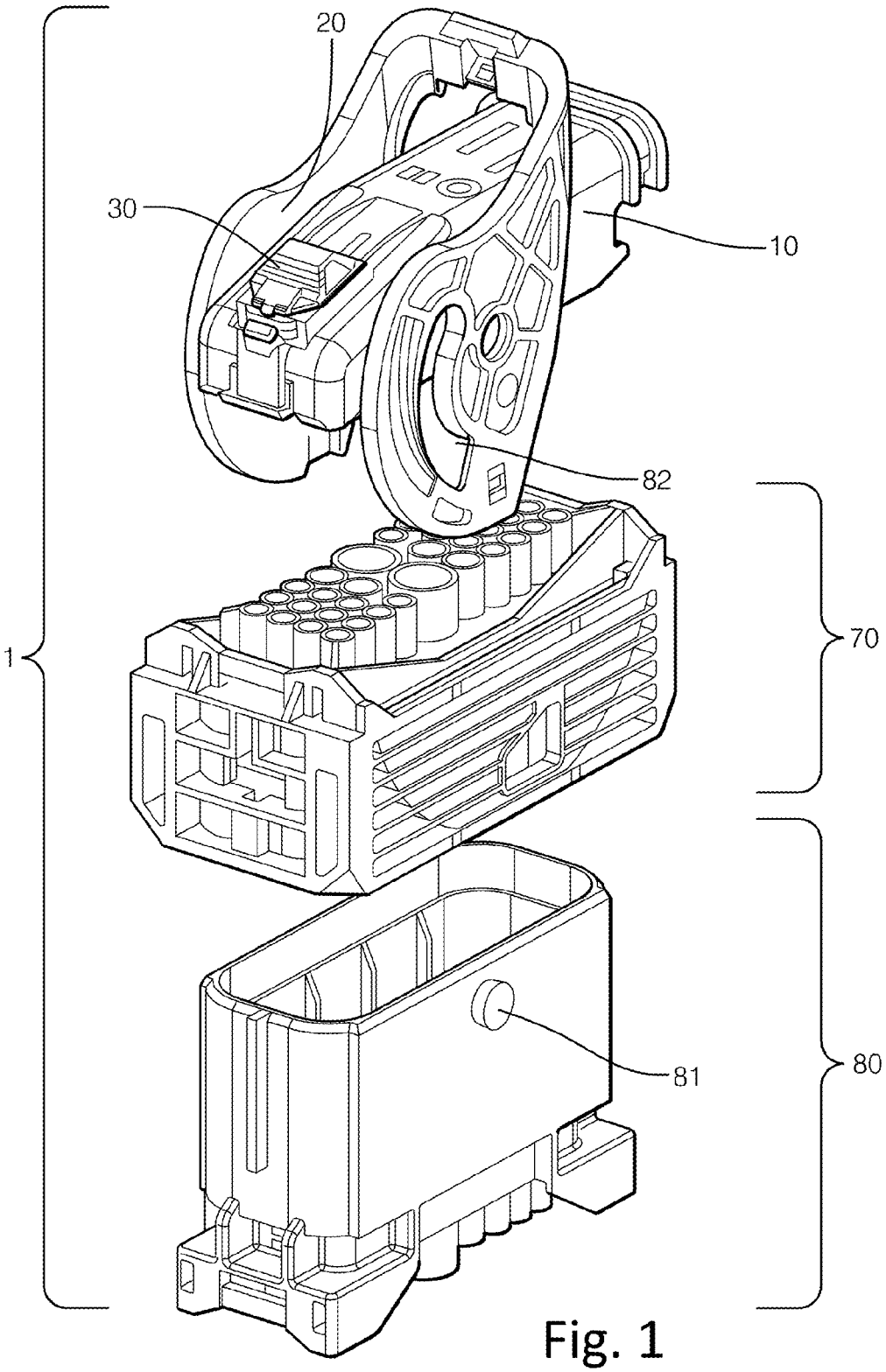
FIG. 1 shows a perspective view of an exploded view of an electrical connector according to a first embodiment.
Figure 9:
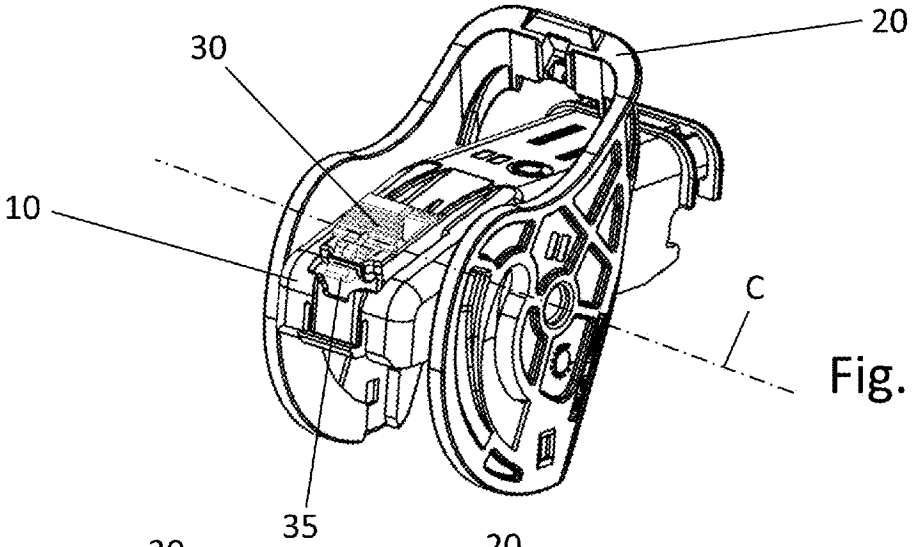
FIG. 9, shows an electrical connector in perspective view with the cover, CPA member and mating assist lever being assembled and the mating assist lever in an open position and the CPA member in an inoperative position according to the first embodiment.

FIG. 1 shows an electrical connector 1 according to a first embodiment. It shows a cover 10, a mating assist lever 20 and a CPA member 30. It further shows an intermediate housing 70 and a movable connection part 80. The electrical connector 1 according to a first embodiment comprises the CPA member 30, the mating assist lever 20 and the cover 10 as shown in FIG. 9 where the parts are in an assembled state. The electrical connector 1 is mateable with a complementary mating connector (not shown).

Typically, the electrical connector 1 and the complementary mating connector operate through some form of cam groove 82 or cam follower arrangement for drawing the complementary mating connector into a mating condition with the electrical connector 1 in response to rotation of the mating assist lever 20.

Figure 2B:
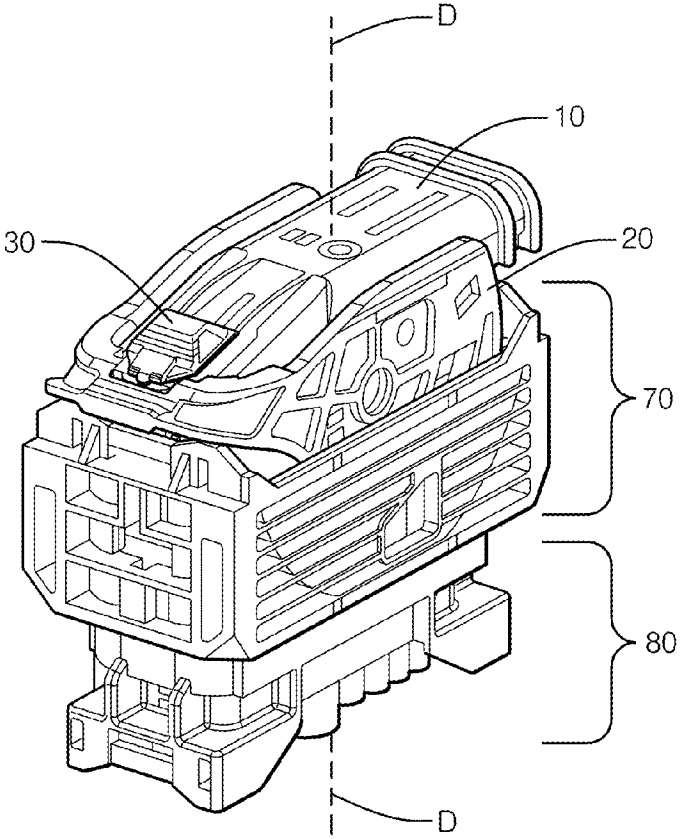
FIG. 2*b* shows an exploded view of the electrical connector according to the first embodiment.
Figure 2A:
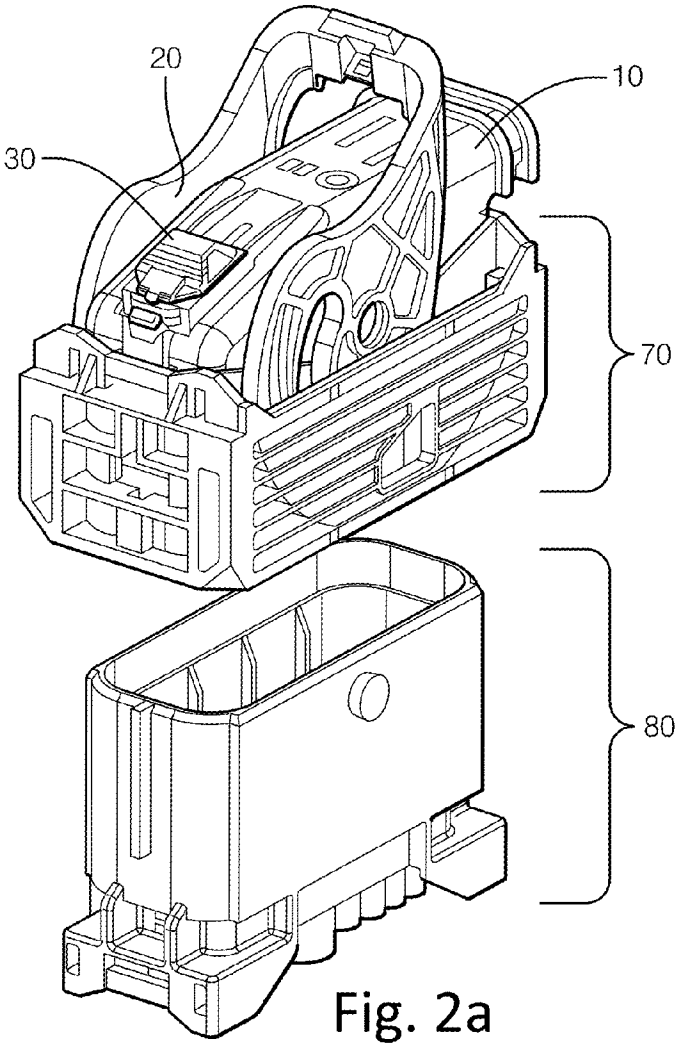
FIG. 2*a* shows a partly exploded view of the electrical connector according to the first embodiment.
Figure 10:
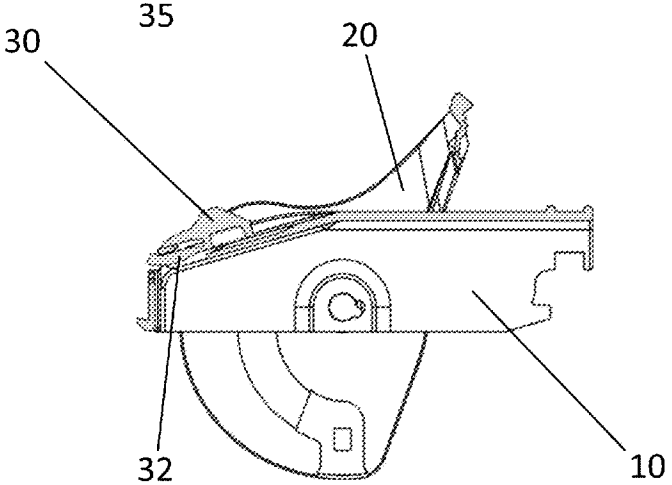
FIG. 10, shown the electrical connector in side view with the cover, CPA member and mating assist lever being assembled and the mating assist lever in an open position and the CPA member in an inoperative position according to the first embodiment.
Figure 11:
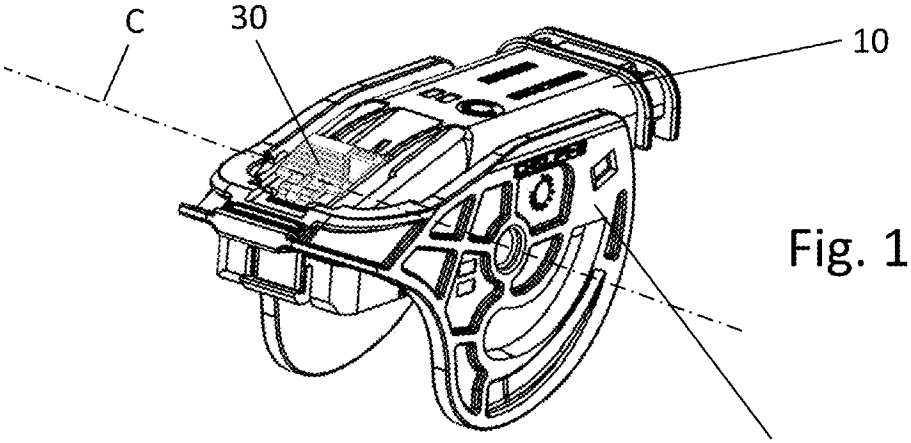
FIG. 11, shows the electrical connector in perspective view with the cover, CPA member and mating assist lever being assembled and the mating assist lever a closed position and the CPA member in a locked position according to the first embodiment.
Figure 12:
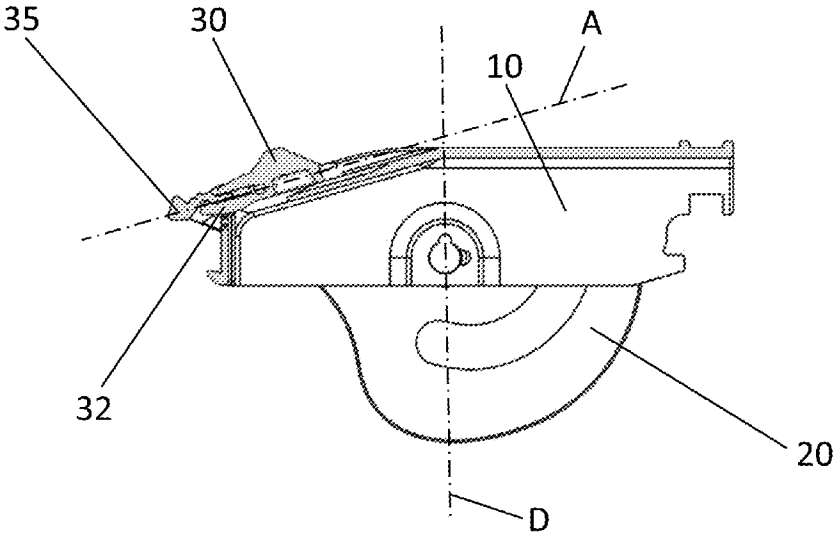
FIG. 12 shows the electrical connector in side view with the cover, CPA member and mating assist lever being assembled and the mating assist lever a closed position and the CPA member in a locked position according to the first embodiment.

Here the movable connection part 80 comprises the cam 81 and the mating assist lever 20 comprises the cam groove 82. The intermediate housing 70 is arranged between the cover 10 and the movable connection part 80 as can be seen in FIGS. 2*a* and 2*b*. The movable connection part 80 is connectable with complementary mating connector (not shown). The mating assist lever 20 is pivotally mounted to the cover 10 and is pivotable between an open position and a closed position. FIGS. 9 and 10 show the mating assist lever 20 in an open position and FIGS. 11 and 12 show the mating assist lever 20 in a closed position.

Figures 3A, 3B, 3C:
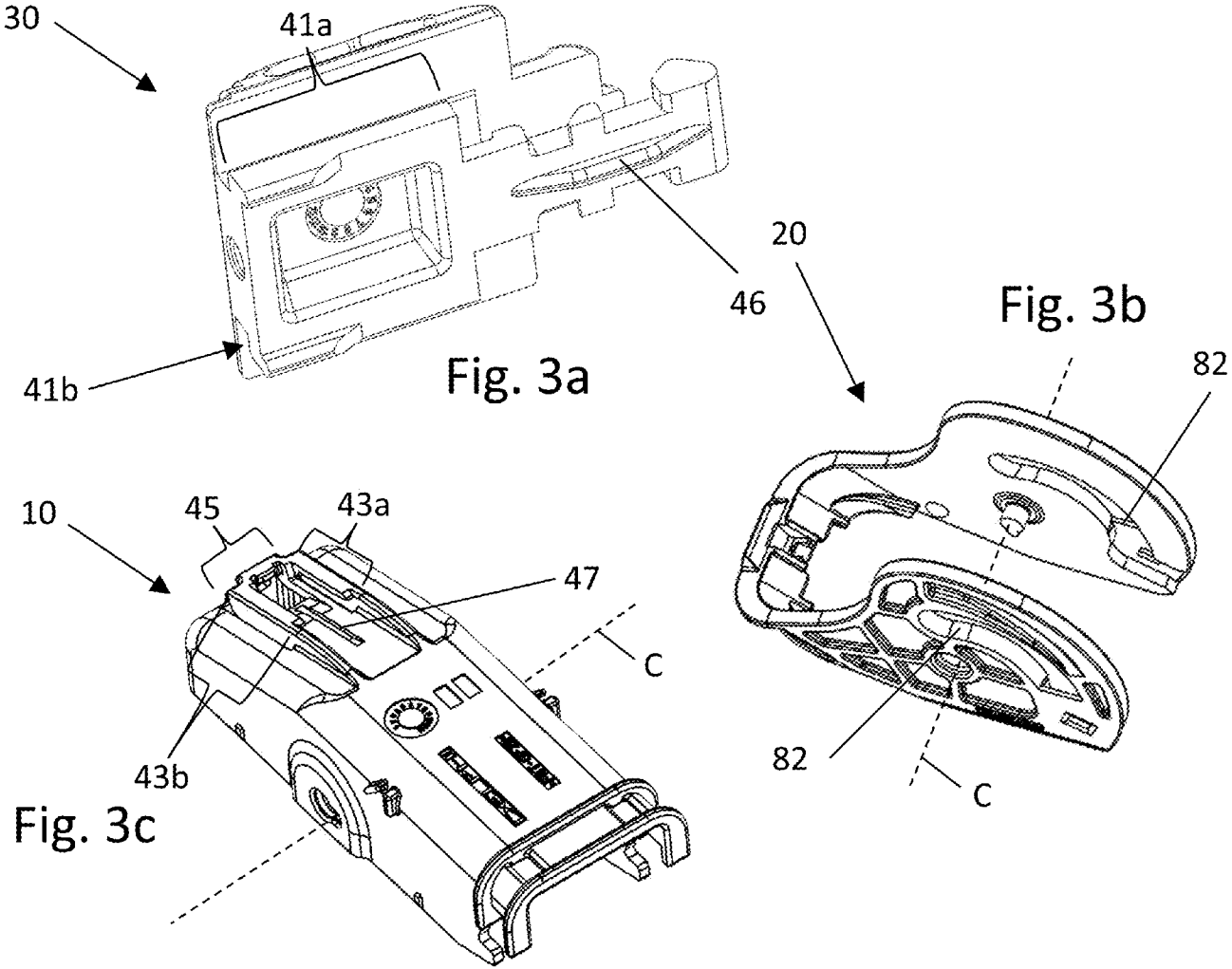
FIG. 3*a* shows a perspective view of a connector positioning assurance (CPA) member according to the first embodiment.
FIG. 3*b* shows a perspective view of a mating assist lever according to the first embodiment.
FIG. 3*c* shows a perspective view of a cover according to the first embodiment.

FIG. 3*a* shows a CPA member 30. FIG. 3*b* shows a mating assist lever 20 and FIG. 3*c* shows a cover 10. The CPA member 30 is slideably mounted to the cover 10. The CPA member 30 is slideable between an inoperative position and a locked position. The CPA member 30 comprises a first guiding groove 41*a* and a second guiding groove 41*b* that cooperate with respectively a first elongated guiding protrusion 43*a* and a second elongated guiding protrusion 43*b* for providing the slideable arrangement between the CPA member 30 and the cover 10. The first and second guiding protrusions 43*a*, 43*b* are provided on a top of the cover 10.

Figure 4:
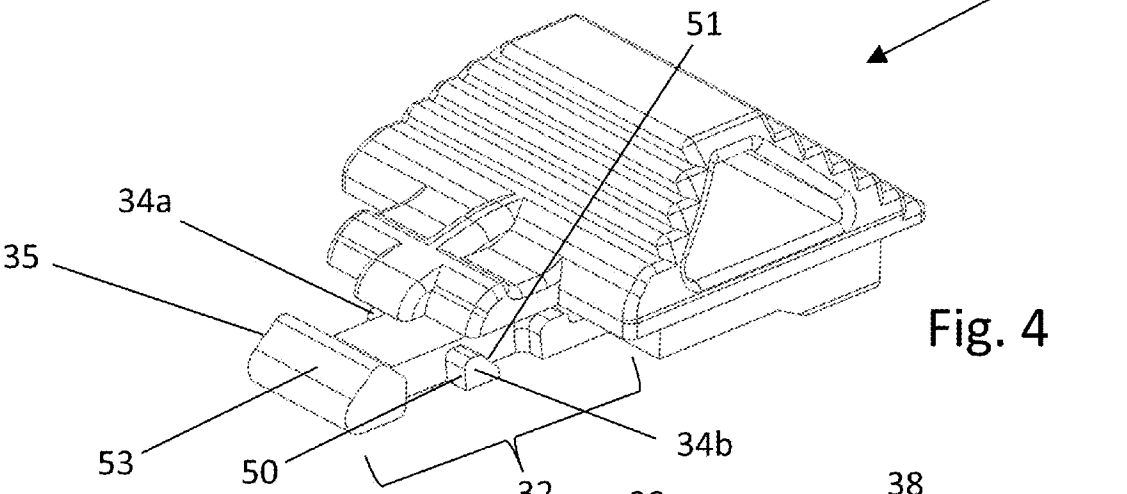
FIG. 4 shows a perspective top view of the CPA member according to the first embodiment.

The CPA member 30 furthermore comprises a flexible locking arm 32, which is shown in FIG. 4. The flexible locking arm 32 is bendable between a bent position and a rest position. The flexible locking arm 32 passes through a frontal opening 45 of the cover 10. The sliding of the CPA member 30 from the inoperative position to the locked position defines a slide direction A and the flexible locking arm 32 comprises a longitudinal axis B that is parallel with the slide direction A. Preferably, a rotating axis C of the mating assist lever 20 is perpendicular to the slide direction A.

In the rest position the flexible locking arm 32 is substantially parallel with the longitudinal axis B of the CPA member 30. In the bent position, the flexible locking arm 32 deforms and is curved.

Figure 5:
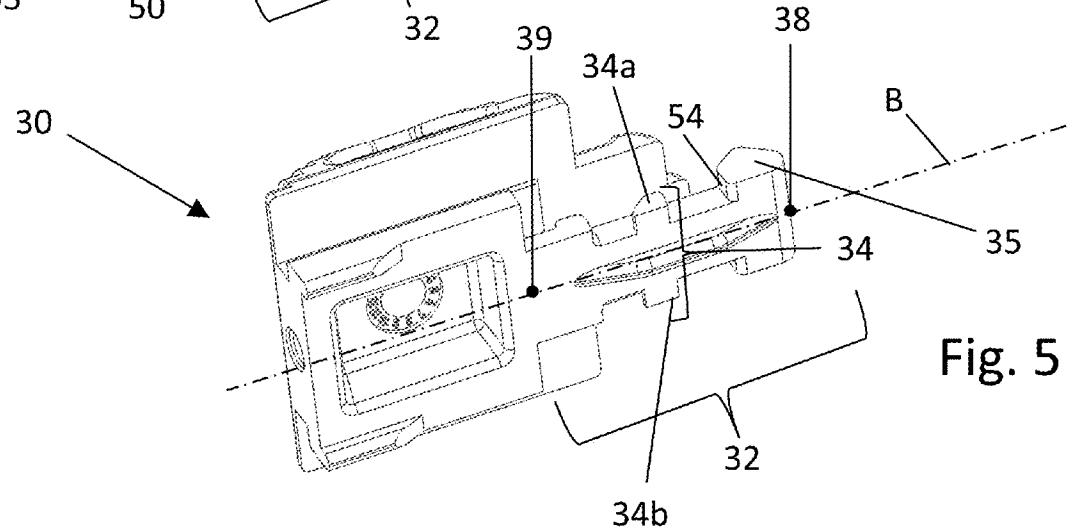
FIG. 5 shows a perspective bottom view of the CPA member according to the first embodiment.

The flexible locking arm 32 comprises a stiffening bar 46, which is shown in FIG. 3*a* and FIG. 5, for providing additional stiffness to the flexible locking arm 32 and for generating a resistance against bending. The size and shape of the stiffening bar 46 may be changed to generate a desired amount of stiffness or resistance against bending of the flexible locking arm 32. The stiffening bar 46 is received in an elongated recess 47 in the cover 10 when the CPA member 30 and the cover 10 are in the assembled state.

Figure 6:
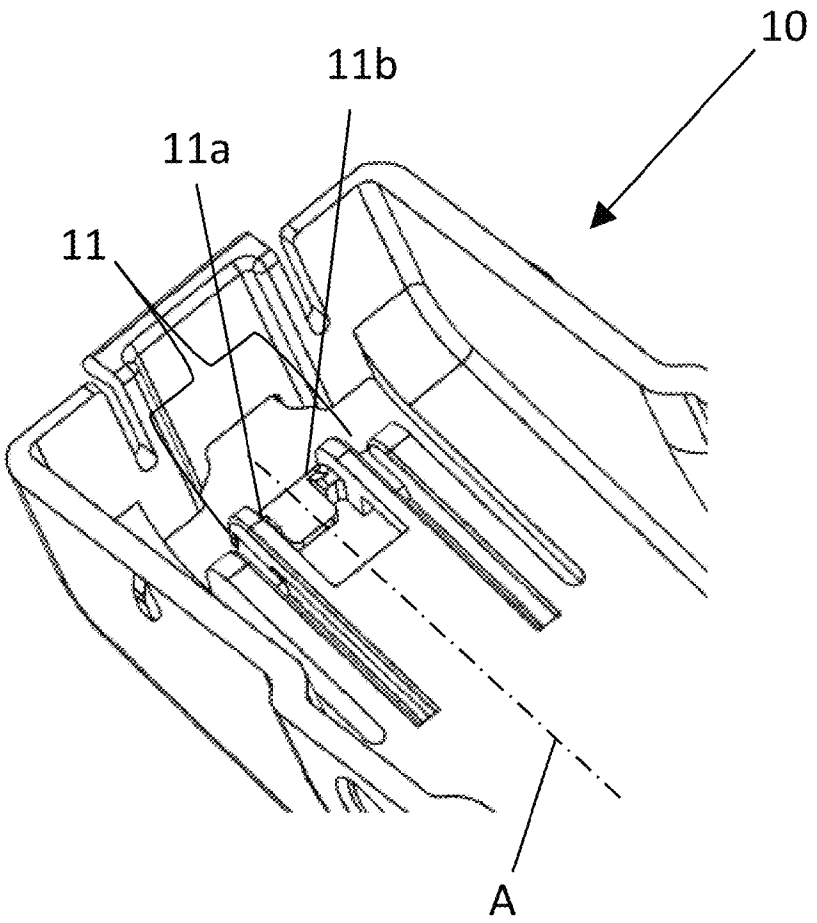
FIG. 6 shows a perspective bottom view of the cover according to the first embodiment.

The cover 10 comprises a blocking shoulder 11 as shown in FIG. 6. Here the blocking shoulder 11 is comprised of a first blocking shoulder 11*a* and a second blocking shoulder 11*b* that are arranged opposite with respect to each other.

The flexible locking arm 32 comprises a blocking ramp 34 for cooperating with the blocking shoulder 11 as shown in FIG. 4. Here the blocking ramp 34 is comprised of a first blocking ramp 34*a* and a second blocking ramp 34*b*. The first and second blocking ramp 34*a*, 34*b* cooperate respectively with the first and second blocking shoulder 11*a*, 11*b* of the cover 10. The first and second blocking ramps 34*a*, 34*b* extend sideways in opposite directions from the longitudinal axis B of the flexible locking arm 32.

When the mating assist lever 20 is in the open position and the CPA member 30 is moved from the inoperative position to the locked position, as shown in FIGS. 9 and 10, the flexible locking arm 32 is in the rest position and the blocking ramp 34 and the blocking shoulder 11 cooperate so as to generate a first threshold force resisting the CPA member 30 from sliding from the inoperative position to the locked position.

As shown in FIG. 4, the blocking ramp 34 comprises a frontal blocking side 50 and a rear blocking side 51. The frontal blocking side 50 is substantially perpendicular with respect to the slide direction A. This may result in generating a relative large first threshold force when cooperating with the blocking shoulder 11. The frontal blocking side 50 may be arranged in more slanted way; however this results in a lower first threshold force compared with the perpendicular frontal blocking side 50.

Figure 7:
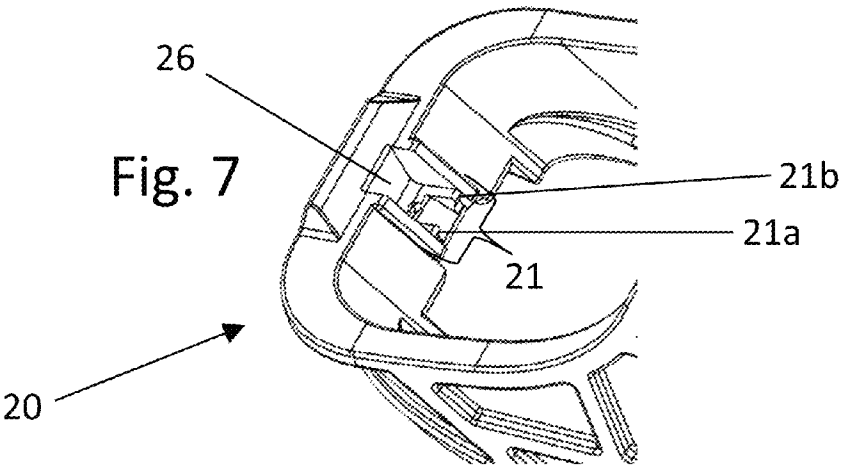
FIG. 7 shows a perspective bottom view of the mating assist lever according to the first embodiment.
Figure 8:
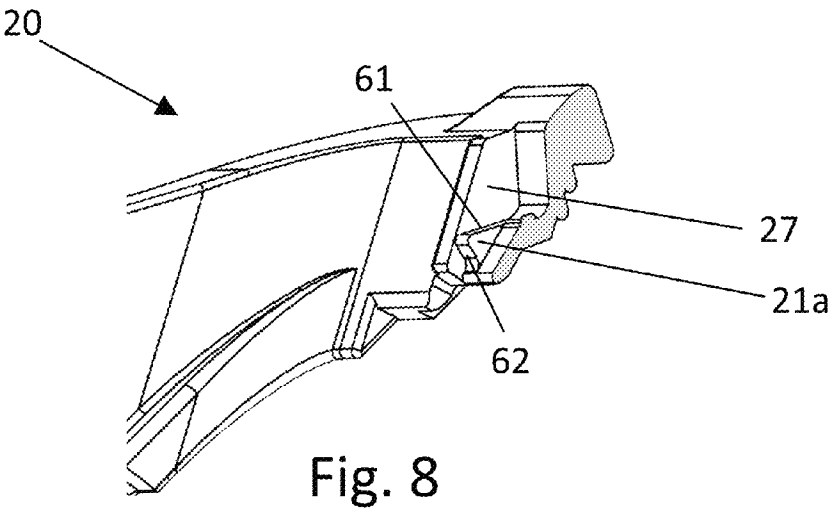
FIG. 8 shows a perspective side view with cut out of the mating assist lever.

The mating assist lever 20 comprises a locking shoulder 21 which is shown in FIG. 7 and FIG. 8. The flexible locking arm 32 comprises a locking ramp 35 for cooperating with the locking shoulder 21. Here the locking ramp 35 comprises a slanted frontal locking side 53.

When the mating assist lever 20 is in the closed position and the CPA member 30 is moved from the inoperative position to the locked position, as shown in FIGS. 11 and 12, the locking ramp 35 and locking shoulder 21 cooperate so as to bend the flexible locking arm 32 from the rest position to the bent position such that it prevents the blocking ramp 34 and the blocking shoulder 11 to cooperate. This is advantageous as in a desired position of the mating assist lever 20 and of the CPA member 30 with respect to the cover 10, the CPA member 130 may be moved from the inoperative position to the locked position. When the mating assist lever 20 is in the closed position and the CPA member 130 is in the inoperative position, the locking ramp 35 and locking shoulder 21 cooperate such as to unblock the blocking ramp 34 with the blocking shoulder 11.

The locking ramp 35 is arranged on a distal end 38 of the flexible locking arm 32 and the blocking ramp 34 is arranged between the locking ramp 35 and a proximal end 39 of the flexible locking arm 32. As the locking ramp 35 moves in an outward direction due to the cooperation with the locking shoulder 21, the blocking ramp 34 is therefore also moved outward and is not able to cooperate with the blocking shoulder 11 anymore. Having the locking ramp 35 at the distal end 38 is also advantageous as it allows the flexible locking arm 32 to be partly received in an interior 27 of a lever pocket 26 in the mating assist lever 20 as will be further explained below.

The bending of the flexible locking arm 32 from the rest position to the bent position requires overcoming a second threshold force. Preferably, the second threshold force is lower than the first threshold force.

The frontal blocking side 50 is more slanted than the slanted frontal locking side 53 resulting in the second threshold force being smaller that the first threshold force. Preferably, the frontal blocking side 50 is perpendicular or not slanted and the slanted frontal locking side 53 is slanted or not perpendicular.

As shown in FIGS. 7 and 8, the mating assist lever 20 comprises a lever pocket 26. The locking shoulder 21 is arranged in an interior 27 of the lever pocket 26. The interior 27 of the lever pocket 26 is arranged to receive the locking ramp 35. By receiving the locking shoulder 21 as well as the locking ramp 35 in the interior 27 of the lever pocket 26, the locking ramp 35 and the locking shoulder 21 are able to cooperate. Moreover, by receiving the locking ramp 35 in the interior 27 enables the flexible locking arm 32 to be in the rest position while the mating assist lever 20 is in the closed position and the CPA member 30 is in the locked position. This is advantageous, as during a mating state of the electrical connector 1 and the complementary connector, the flexible locking arm 32 may be in an unstressed condition as it is in the rest position. This may allow for a longer life time of the CPA member 30. In other words, the electrical connector 1 is arranged such that when the mating assist lever 20 is in the closed position and the CPA member 30 is in the locked position the flexible locking arm 32 is in the rest position.

The electrical connector 1 is arranged such that when the mating assist lever 20 is in the closed position and the CPA member 30 is moved from the locked position to the inoperative position, the locking ramp 35 and the locking shoulder 21 cooperate such as to bend the flexible locking arm 32 from the rest position to the bent position. For this purpose, the locking shoulder 21, in this case comprised of a first locking shoulder 21*a* and a second locking shoulder 21*b*, comprises of a slanted front locking shoulder 61. The locking ramp 35 comprises a rear locking side 54 that cooperates with the slanted front locking shoulder 61. The rear locking side 54 is arranged non-slanted or perpendicular.

A mating axis D between the electrical connector 1 and the complementary electrical connector lie in a same imaginary plane with the slide direction A. The mating axis D and the slide direction A are arranged under an angle of preferably substantially 90 degrees, more preferably substantially 80 degrees and in a further preference substantially 60 degrees. In FIG. 10 it is shown that the slide direction A is angled with respect to the mating axis D.

The mating assist lever 20 comprises a first and a second locking shoulder 21*a*, 21*b* that cooperate with the locking ramp 35. Here, the locking ramp 35 is shaped as an elongated bar that is perpendicular to the longitudinal axis B.

In a variant, not shown here, the flexible locking arm comprises a first and a second locking ramp extending sideways in opposite directions from a longitudinal axis of the flexible locking arm. The first and second locking shoulder cooperate respectively with the first and second locking ramp.

Figure 13:
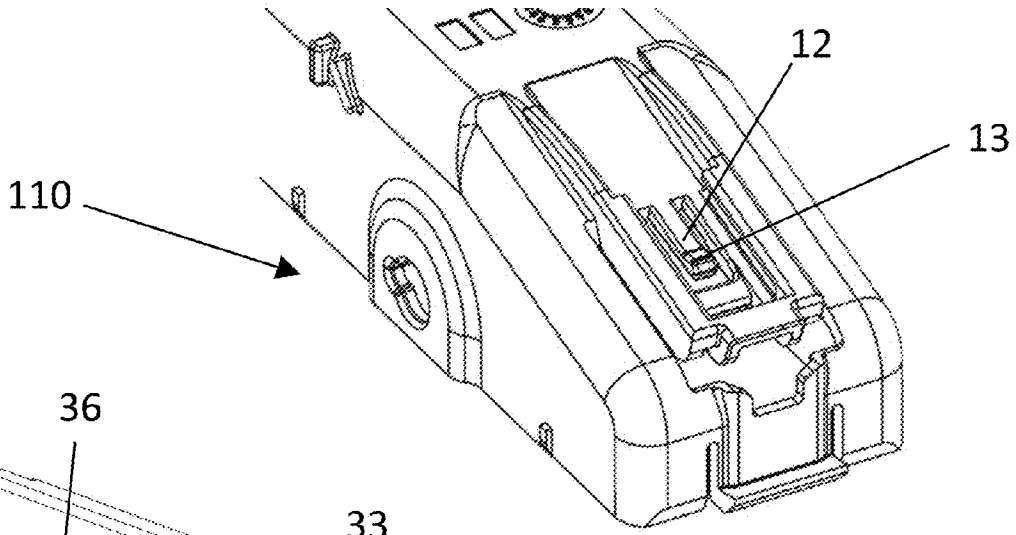
FIG. 13 shows a CPA member according to a second embodiment.
Figure 14:
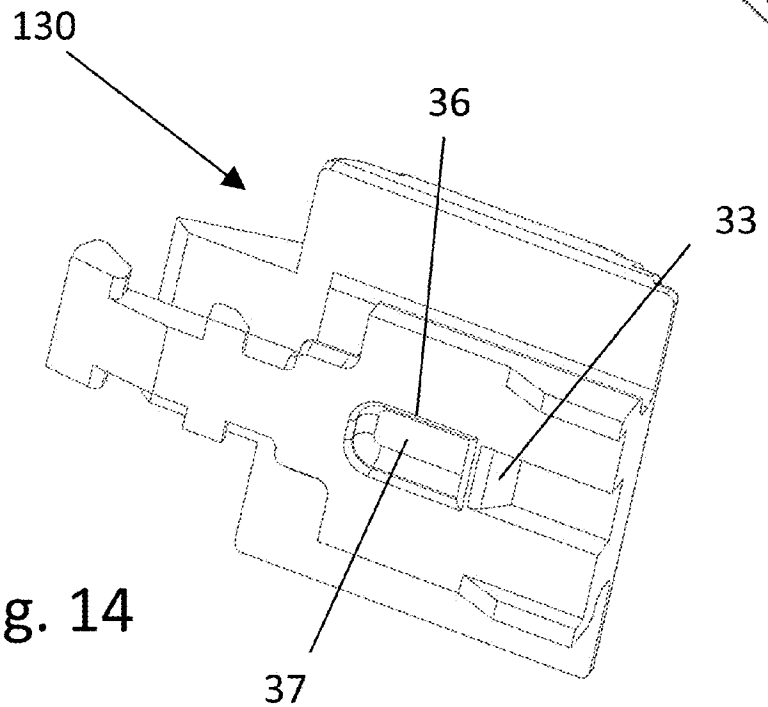
FIG. 14 shows a cover according to the second embodiment.

FIGS. 13 and 14 show a second embodiment of the electrical connector 101 according to the invention. The second embodiment if similar to the first embodiment, however a CPA member 130 now comprises a CPA pocket 36 and an auxiliary shoulder 33 and a cover 110 comprises a flexible lance 12 arranged with an auxiliary ramp 13. Similar components are indicated with the same reference numbers as in the first embodiment.

The auxiliary shoulder 33 is arranged in an interior of the CPA pocket 36 and the interior 37 of the CPA pocket 36 is arranged to receive the auxiliary ramp 13.

The electrical connector 101 is configured such that when the mating assist lever 20 is in the open position and the CPA member 130 is moved from the inoperative position to the locked position, the flexible lance 12 is in a rest position and the auxiliary ramp 13 and the auxiliary shoulder 33 cooperate so as to resist against the CPA member 130 from sliding from the inoperative position to the locked position by bending the flexible lance 12 from the rest position to a bent position.

The electrical connector 101 is arranged such that when the mating assist lever 20 is in the closed position and the CPA member 130 is moved from the locked position to the inoperative position, the auxiliary ramp 13 and the auxiliary shoulder 33 cooperate such as to bend the flexible lance 12 from the rest position to the bent position so as to provide a resistance. The bending of the flexible lance 12 from the rest position to the bent position requires overcoming a third threshold force, wherein the third threshold force is smaller than the first threshold force.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

LIST OF REFERENCE NUMERALS

Electrical connector . . . 1
Cover . . . 10
Blocking shoulder . . . 11
Mating assist lever . . . 20
Locking shoulder . . . 21
Connector positioning assurance (CPA) member . . . 30
Flexible locking arm . . . 32
Blocking ramp . . . 34
Locking ramp . . . 35
Lever pocket . . . 26
Interior of the lever pocket . . . 27
Distal end of the flexible locking arm . . . 38

Proximal end of the flexible locking arm . . . 39
Slide direction . . . A
Longitudinal axis . . . B
Rotating axis . . . C
Mating axis . . . D
First locking shoulder . . . 21*a*
Second locking shoulder . . . 21*b*
First blocking ramp . . . 34*a*
Second blocking ramp . . . 34*b*
First blocking shoulder . . . 11*a*
Second blocking shoulder . . . 11*b*
CPA pocket . . . 36
Interior of the CPA pocket . . . 37
Auxiliary shoulder . . . 33
Auxiliary ramp . . . 13
Flexible lance . . . 12
Slanted front locking shoulder . . . 61
Frontal blocking side . . . 50
Rear blocking side . . . 51
Slanted frontal locking side . . . 53
Rear locking side . . . 54
First guiding groove . . . 41*a*
Second guiding groove . . . 41*b*
First elongated guiding protrusion . . . 43*a*
Second elongated guiding protrusion . . . 43*b*
Frontal opening . . . 45
Stiffening bar . . . 46
Elongated recess . . . 47
Intermediate housing . . . 70
Movable connection part . . . 80
Cam . . . 81
Cam groove . . . 82

The invention claimed is:

1. An electrical connector configured to mate with a complementary mating connector, said electrical connector comprising:

a cover having a blocking shoulder;

a mating assist lever having a locking shoulder, pivotally mounted to the cover, and configured to pivot between an open position and a closed position;

a connector positioning assurance (CPA) member having a flexible locking arm configured to bend between a bent position and a rest position, slideably mounted to the cover and configured to slide between an inoperative position and a locked position, said flexible locking arm comprising:

a blocking ramp having a frontal blocking side configured to cooperate with the blocking shoulder, wherein the frontal blocking side of the blocking ramp and the blocking shoulder cooperate so as to generate a first threshold force resisting the CPA member from sliding from the inoperative position to the locked position when the flexible locking arm is in the rest position, the mating assist lever is in the open position, and the CPA member is moved from the inoperative position to the locked position, and a locking ramp having a slanted frontal locking ramp configured to cooperate with the locking shoulder, wherein the slanted frontal locking ramp of the locking ramp and the locking shoulder cooperate so as to bend the flexible locking arm from the rest position to the bent position such that it prevents the blocking ramp and the blocking shoulder from cooperating when the mating assist lever is in the closed position and the CPA member is moved from the inoperative position to the locked position, wherein an angle formed by the frontal blocking side is greater than an angle formed by the slanted frontal locking ramp, wherein the bending of the flexible locking arm from the rest position to the bent position requires overcoming a second threshold force, and wherein the second threshold force is lower than the first threshold force.

2. The electrical connector according to claim 1, wherein the mating assist lever comprises a lever pocket and wherein the locking shoulder is arranged in an interior of the lever pocket that is configured to receive the locking ramp.

3. The electrical connector according to claim 1, wherein the electrical connector is configured such that the flexible locking arm is in the rest position when the mating assist lever is in the closed position and the CPA member is in the locked position.

4. The electrical connector according to claim 1, wherein the electrical connector is configured such that the locking ramp and the locking shoulder cooperate such as to bend the flexible locking arm from the rest position to the bent position when the mating assist lever is in the closed position and the CPA member is moved from the locked position to the inoperative position.

5. The electrical connector according to claim 1, wherein the locking ramp is arranged on a distal end of the flexible locking arm and the blocking ramp is arranged between the locking ramp and a proximal end of the flexible locking arm.

6. The electrical connector according to claim 1, wherein sliding the CPA member from the inoperative position to the locked position defines a slide direction and wherein the flexible locking arm is arranged with a longitudinal axis parallel to the slide direction.

7. The electrical connector according to claim 6, wherein a rotating axis of the mating assist lever is perpendicular to the slide direction.

8. The electrical connector according to claim 6, wherein a mating axis between the electrical connector and the complementary electrical connector lie in a same imaginary plane with the slide direction and an angle formed between the mating axis and the slide direction is less than 90 degrees.

9. The electrical connector according to claim 1, wherein the flexible locking arm comprises a first and a second blocking ramp extending sideways in opposite directions from a longitudinal axis of the flexible locking arm and wherein the cover comprises a first and a second blocking shoulder that respectively cooperate with the first and second blocking ramps.

10. The electrical connector according to claim 1, wherein the CPA member comprises a CPA pocket and an auxiliary shoulder, wherein the cover comprises a flexible lance configured with an auxiliary ramp, and wherein the auxiliary shoulder is arranged in an interior of the CPA pocket that is configured to receive the auxiliary ramp.

11. The electrical connector according to claim 10, wherein the electrical connector is configured such that the flexible lance is in the rest position and the auxiliary ramp and the auxiliary shoulder cooperate so as to resist against the CPA member from sliding from the inoperative position to the locked position by bending the flexible lance from the rest position to the bent position when the mating assist lever is in the open position and the CPA member is moved from the inoperative position to the locked position.

12. The electrical connector according to claim 10, wherein the electrical connector is configured such that the auxiliary ramp and the auxiliary shoulder cooperate such as to bend the flexible lance from the rest position to the bent position so as to provide a resistance when the mating assist lever is in the closed position and the CPA member is moved from the locked position to the inoperative position.

13. The electrical connector according to claim 10, wherein the bending of the flexible lance from the rest position to the bent position requires overcoming a third threshold force and wherein the third threshold force is less than the first threshold force.

14. A connector assembly, comprising:

the electrical connector according to claim 1; and an element selected from the group consisting of: an intermediate housing, a movable connection part, and the complementary mating connector.

* * * * *